United States Patent [19]

Wedel et al.

[11] Patent Number: 4,882,854

[45] Date of Patent: Nov. 28, 1989

[54] GUIDE ROLL APPARATUS FOR A DRYER OF A PAPER MACHINE DRYING SECTION

[75] Inventors: Gregory L. Wedel, Beloit, Wis.; J. Larry Chance, Rockton, Ill.

[73] Assignee: Beloit Corporation, Beloit, Wis.

[21] Appl. No.: 54,461

[22] Filed: May 26, 1987

[51] Int. Cl.[4] ..... F26B 13/00; F26B 13/30

[52] U.S. Cl. ..... 34/115; 34/117

[58] Field of Search ..... 34/114, 115, 116, 122, 34/123

[56] References Cited

U.S. PATENT DOCUMENTS

| | | | |
|---|---|---|---|
| 3,345,757 | 10/1967 | Daane | 34/115 |
| 3,868,780 | 3/1975 | Soininen et al. | 34/116 |
| 4,202,113 | 5/1980 | Kankaanpaa | 34/114 |
| 4,359,827 | 11/1982 | Thomas | 34/114 |
| 4,441,263 | 4/1984 | Vedenpaa | 34/115 |
| 4,516,330 | 5/1985 | Eskelinen et al. | 34/114 |
| 4,677,762 | 7/1987 | Futcher | 34/116 |

*Primary Examiner*—Henry A. Bennet

*Attorney, Agent, or Firm*—Dirk Veneman; Raymond Campbell; David Archer

[57] ABSTRACT

A guide roll apparatus is disclosed for guiding a contiguous web and web-supporting felt through a drying section of a paper machine. The apparatus includes a rotatable guide roll having an outer cylindrical surface defining a first and a second edge portion and a central portion disposed between the edge portions. The first edge portion defines a first plurality of air flow channels such that in use of the apparatus, when the web and felt are guided around the rotatable guide roll, air entrapped between the first edge portion and the felt wrapped around the first edge portion is permitted to flow through the first plurality of channels away from the felt so that fluttering of the web during guidance around the first edge portion is inhibited. The apparatus also includes a second edge portion which defines a second plurality of air flow channels such that in use of the apparatus, when the web and the felt are guided around the rotatable guide roll, air entrapped between the second edge portion and the felt wrapped around the second edge portion is permitted to flow through the second plurality of channels away from the felt so that fluttering of the web during guidance around the second edge portion is inhibited.

13 Claims, 3 Drawing Sheets

Fig. 1 PRIOR ART
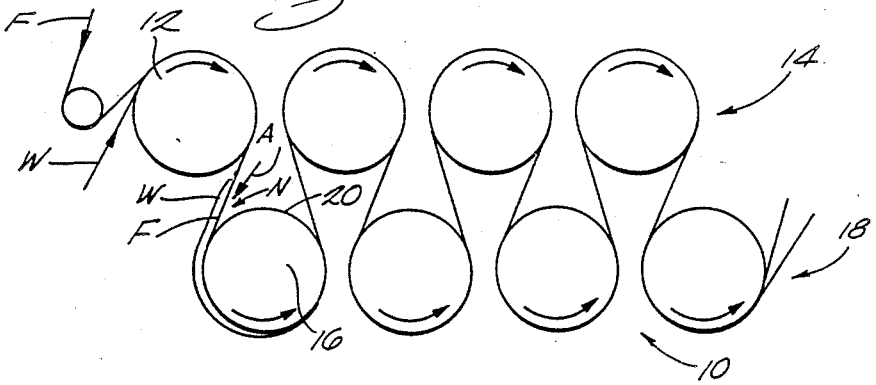
Fig. 2 PRIOR ART
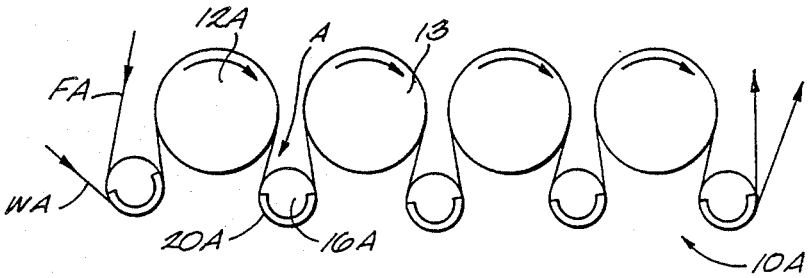
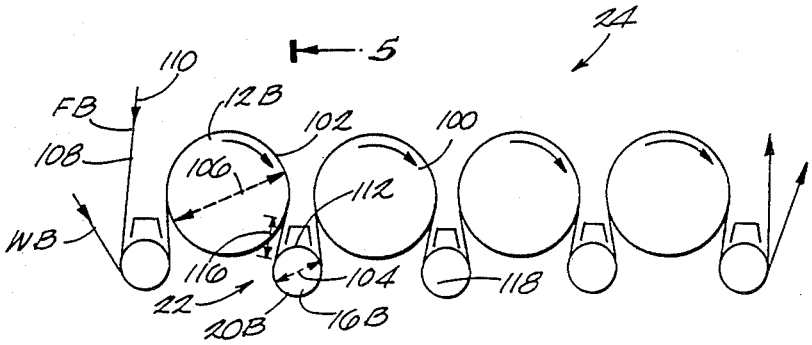
Fig. 3

Fig. 4
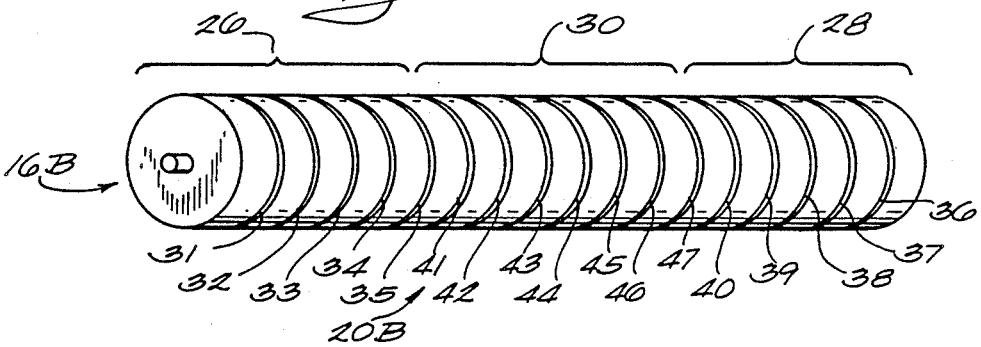
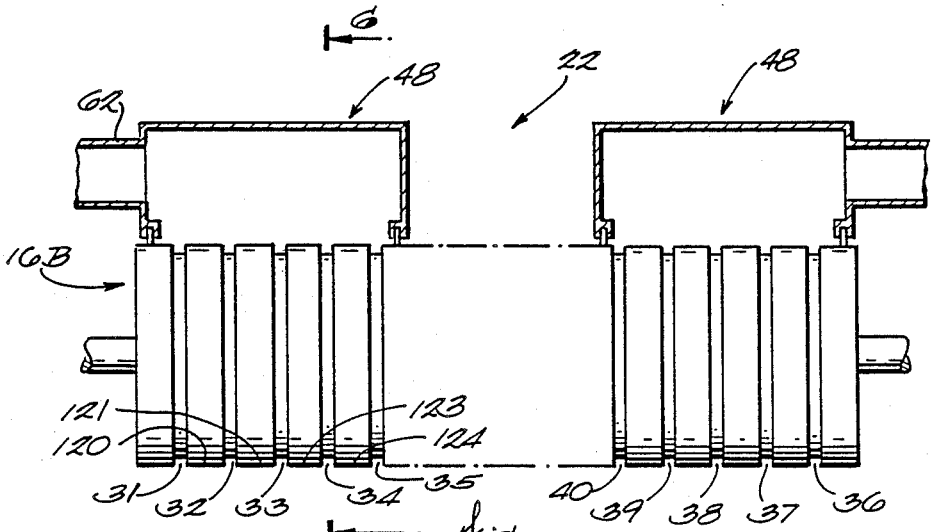
Fig. 5
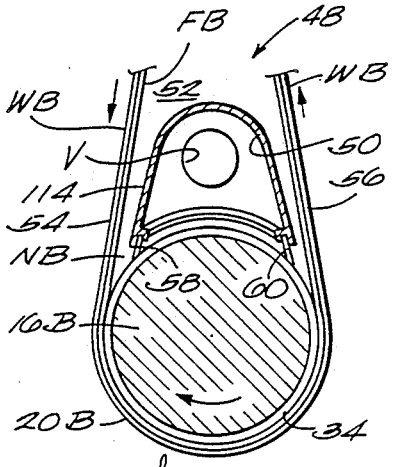
Fig. 6
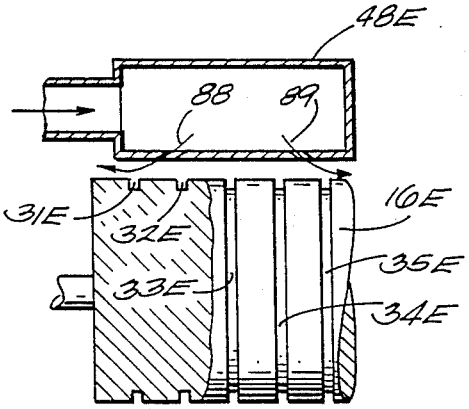
Fig. 10

GUIDE ROLL APPARATUS FOR A DRYER OF A PAPER MACHINE DRYING SECTION

BACKGROUND OF THE INVENTION

1. Field of the Invention

This invention relates to a guide roll apparatus for a dryer of a paper machine drying section. More specifically, this invention relates to a guide roll apparatus in which the web and a web-supporting felt disposed contiguous relative to each other are guided through the drying section of a papermaking machine.

2. Information Disclosure Statement

For many years, so-called "serpentine run" or "uno-run" drying sections have been employed by papermakers in order to dry the formed web emerging from a press section of the papermaking machine. Such serpentine type drying sections typically included an upper and a lower line of dryer drums and the web to be dried would successively move supported by a felt between alternate upper and lower dryer drums. Although the aforementioned serpentine run has been extensively employed, such arrangement has certain inherent disadvantages. For example, when both the upper and lower line of dryer drums are heated, the web comes into physical contact only with the heated dryer drums of the upper line of dryers because only the felt comes into direct contact with each of the dryer drums of the lower line. In operation of such serpentine drying sections, the application of heat to the lower line of dryers has, to a large extent, been ineffective due the heat-insulating effect of the drying felt disposed between the surface of each lower drying drum and the supported web. In view of the resultant wastage of heating steam and the relatively costly requirement for such lower line of dryer drums, such lower line of drums have recently been replaced by guide rolls (or transfer rolls) disposed between each adjacent upper dryer drum. Throughout this specification, the term "guide roll" is intended to include transfer rolls for transferring the web between adjacent dryers or grooved vacuum rolls. This so-called "Bel Run" arrangement with guide rolls disposed between adjacent upper drying drums, has reduced the steam requirements compared with the aforementioned serpentine run arrangement. Also, such guide rolls are smaller and generally less costly than the corresponding lower dryer drums. Furthermore, due to the smaller size of the guide rolls, the draw, or length of the felt, between an upper dryer drum and a respective guide roll is considerably reduced compared with the serpentine run thereby avoiding, to a large degree, problems arising from the edges of the web fluttering when operating at high production rates of 3,000 fpm or more. Another advantage of the Bel Run system is that the overall height of the Bel Run is less than the height of a serpentine run.

With the ever-increasing production speeds of papermaking machines, however, it is not uncommon to operate dryer sections of the Bel Run type in excess of 4,000 fpm. At such speeds, even with the relatively short draw between the guide roll and associated dryer drum, there exists a tendency for the edges of the web to lift and flutter relative to the supporting felt as the contiguous felt and web extend around and wrap a portion of the guide roll.

In the prior art, various types of vacuum rolls have been employed in an attempt to adequately draw the web, and particularly the web edges, into close conformity with the supporting felt. However, such vacuum rolls are relatively costly to manufacture, such cost approaching the cost of the manufacture of a corresponding lower dryer drum of a serpentine run system.

The present invention provides a greatly simplified type of guide roll which avoids the complex structure of the aforementioned vacuum rolls used previously.

The present invention, essentially, includes a guide roll having a plurality of spaced, circumferential grooves defined by the external surface of the guide roll such that as the felt and web wrap around the guide roll, the buildup of air pressure at the ingoing nip defined by the felt and the guide roll, is dissipated through the plurality of channels, or grooves.

More specifically, the present invention includes a guide roll in which the edge portions of the guide roll have a plurality of spaced, circumferential grooves in combination with a vacuum hood, or vacuum inducing device, disposed in the pocket formed by the ingoing and outgoing felt and the guide roll such that the buildup of pressure at the ingoing nip is drawn away from this nip through the grooves towards the vacuum hood.

Alternately, the present invention accomplishes the same purpose by providing a hollow guide roll defining a plurality of radially-extending holes disposed adjacent to the respective edge portions of the roll. A partial vacuum is applied to the hollow roll through one or more journals of the roll such that in use, the air pressure built up between the felt and the edge portions of the roll is drawn away through the holes towards the vacuum, and additionally, vacuum support is provided directly to the web edges as they wrap around the guide roll.

Therefore, it is a primary object of the present invention to overcome the aforementioned complexity and cost factors involved with the prior art guide rolls and to provide a guide roll apparatus that offers a significant contribution to the art of drying paper webs in a papermaking machine.

Another object of the present invention is the provision of a guide roll apparatus in which a first and second edge portion of a guide roll defines a plurality of spaced, circumferential grooves such that in use of the apparatus, the buildup of pressure at the ingoing nip is dissipated through the grooves towards a vacuum hood disposed within a pocket defined by the ingoing and outgoing felt and the guide roll.

Another object of the present invention is the provision of a guide roll apparatus which includes a hollow guide roll having radial holes disposed adjacent the respective side edges of the roll. Vacuum is applied through the hollow guide roll such that in use, the buildup of air pressure between the felt and particularly the edge portions of the guide roll is dissipated through the holes towards the vacuum.

Another object of the present invention is the provision of a guide roll in which the hollow guide roll includes a divider plate for dividing an enclosure of the hollow guide roll into a first and second enclosure with the first and second enclosure being, respectively, in communication with the holes of the first and second edge portions.

Another object of the present invention is the provision of a guide roll apparatus in which the divider plate defines a restrictor opening such that a greater vacuum is applied to one edge portion than to the other edge portion. This greater vacuum is used when threading a tail of a web so that loss of vacuum through the remaining unwrapped edge portion is inhibited.

Other objects and advantages of the present invention will be readily apparent to those skilled in the art by a consideration of the following detailed description of the preferred embodiment of the present invention taken in conjunction with the annexed drawings.

SUMMARY OF THE INVENTION

The present invention relates to a guide roll apparatus which is disposed adjacent to a dryer of a paper machine drying section. More particularly, the invention relates to a guide roll apparatus which guides a contiguous web and web-supporting felt through the drying section. The apparatus includes a rotatable guide roll having an outer cylindrical surface which defines a first and a second edge portion. The cylindrical surface also defines a central portion which is disposed between the edge portions. The first edge portion defines a first plurality of air flow channels such that in use of the apparatus, when the web and felt are guided around the rotatable guide roll, air entrapped between the first edge portion and the felt wrapped around the first edge portion, is permitted to flow through the first plurality of channels away from the felt so that fluttering of the web during guidance around the first edge portion is inhibited. Similarly, the second edge portion also defines a second plurality of air flow channels such that in use of the apparatus, when the web and felt are guided around the rotatable guide roll, air entrapped between the second edge portion and the felt wrapped around the second edge portion is permitted to flow through the second plurality of channels away from the felt so that fluttering of the web during guidance around the second edge portion is inhibited.

In one particular embodiment of the present invention, the first and the second plurality of air flow channels are, respectively, a first and a second plurality of spaced, circumferential grooves. Furthermore, the central portion may also define a third plurality of spaced, circumferential grooves for inhibiting a buildup of air pressure between the central portion and the felt thereby inhibiting detachment of the web relative to the felt during guidance of the web around the guide roll. A vacuum means is disposed adjacent to the guide roll within the pocket defined by the ingoing and outgoing felt and the guide roll. This vacuum means enhances the flow of air through the first and second plurality of grooves. The vacuum means includes a hood which is disposed within the pocket. The hood is sealed by means of seal means disposed between the hood and the guide roll, or felt, for sealing the hood relative to the guide roll. The seal means can be mechanical seals or air jet seals. The hood is connected to a source of partial vacuum or a source of pressure which can be used to induce a vacuum such that in use of the apparatus, air entrapped between the felt and the wrapped portion of the edge portions is drawn through the first and second plurality of channels and through the hood thereby inhibiting fluttering of the respective edges of the web.

In an alternative embodiment Of the present invention, the guide roll includes an enclosure means defined by the guide roll. The first and second plurality of air flow channels are, respectively, a first and second plurality of holes extending between the enclosure means and the cylindrical surface of the guide roll such that air flows through the holes from the cylindrical surface towards the enclosure. More particularly, the guide roll also includes a first and second journal bearing disposed respectively adjacent to the first and second edge portions of the guide roll for rotatably supporting the guide roll. A first and second journal are rigidly connected to the respective first and second edge portions. These first and second journals are rotatably supported by, respectively, the first and second journal bearings. The first and second journals respectively define first and second bores. The guide roll apparatus also includes a vacuum means which is disposed adjacent to the guide roll for enhancing the flow of air through the first and second plurality of holes and through the enclosure means which is in fluid communication with, respectively, the first and second bores. The vacuum means is connected, respectively, to the first and second bores to assist air flow.

The guide roll also includes a divider plate means which is disposed within the enclosure means between the first and second edge portions for dividing the enclosure means into a first and a second enclosure. This arrangement is such that the first and second enclosures are in fluid communication respectively with the first and second bores.

In a further modification, in order to assist the threading of a tail of the web, the divider plate defines a restrictor opening. The vacuum means is disposed adjacent to the guide roll and in fluid communication with one of the enclosures such that in use of the apparatus when threading the tail of the web, a greater vacuum is applied to the enclosure which is adjacent to the tail, this greater vacuum being due to the restrictor opening. By this means, the loss of vacuum to that edge portion that is unwrapped by the web is avoided.

Although the present invention is described hereinafter with reference to a preferred and alternative embodiments, it will be evident to those skilled in the art that many variations and modifications of the basic concept of the present invention can be carried out without departing from the spirit and scope of the invention as defined by the appended claims. Such modifications include helically-grooved guide rolls, edge portions having blind holes drilled therein, lateral grooves and the like.

BRIEF DESCRIPTION OF THE DRAWINGS

FIG. 1 is a side-elevational view of a prior art serpentine type dryer section showing an upper and a lower line of dryer drums with the web tending to detach from the supporting felt during guidance of the same around a lower dryer drum.

FIG. 2 shows a typical Bel Run system in which the lower dryer drums are replaced by smaller vacuum rolls.

FIG. 3 is a side-elevational view of a Bel Run drying section according to the present invention in which the plurality of pocket ventilation rolls are replaced by guide rolls having spaced, circumferential grooves and vacuum hoods disposed within the respective pockets near the edges.

FIG. 4 is an enlarged, perspective view of one of the guide rolls of the embodiment shown in FIG. 3 showing a first and second edge portion of the guide roll having spaced, circumferential grooves. This roll also includes a central portion which is grooved.

FIG. 5 is an enlarged, sectional view taken on the line 5—5 of FIG. 3 showing the vacuum means disposed adjacent to the edge portions of the guide roll.

FIG. 6 is a sectional view taken on the line 6—6 of FIG. 5 showing how the buildup of air pressure at the ingoing nip is dissipated through the circumferential grooves and vacuum hood.

FIG. 10 is a sectional view showing an alternative embodiment of the present invention in which the vacuum box is replaced by a blow box which induces a vacuum by the Coanda effect.

Similar reference characters refer to similar parts throughout the various embodiments of the present invention.

DETAILED DESCRIPTION OF THE DRAWINGS

Figure 7:
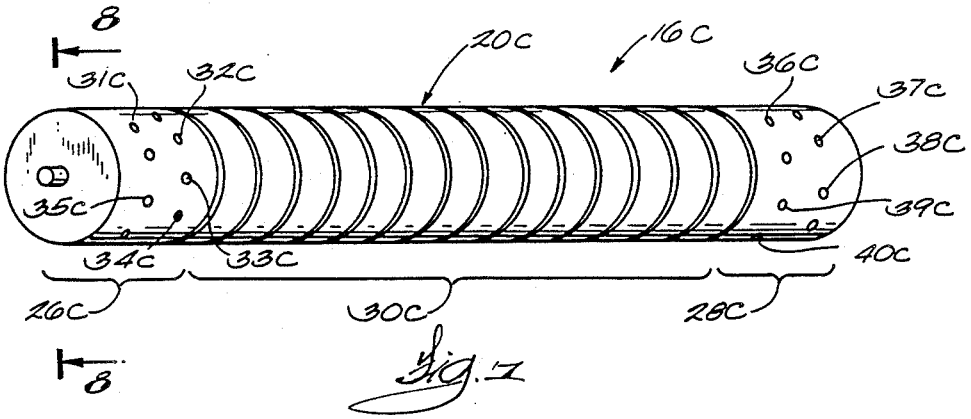
FIG. 7 is a perspective view of a guide roll according to an alternative embodiment of the present invention showing the central portion being grooved and the first and second edge portions defining a plurality of holes.

FIG. 1 is a side-elevational view of a prior art type serpentine run, or Uno-Run dryer section generally designated 10. The web W is wrapped by the felt F around a first dryer drum 12 of an upper line of dryer drums generally designated 14. The web W and felt F leave the heated upper dryer drum 12 and extend in open draw towards and around a lower dryer drum 16 of a lower line of dryer drums generally designated 18. The lower dryer drum 16 is heated but the felt F is disposed between the heated surface 20 of the dryer drum 16 and the web W so that the drying effect of the dryer drum 16 is reduced. Furthermore, due to the pumping effect of the wedge of air A at the ingoing nip N defined by the felt F and the surface 20 of the dryer drum 16, there exists a tendency of the web W to detach from the felt F as shown in FIG. 1.

FIG. 2 is a side-elevational view of a typical prior art Bel Run type dryer section 10A including a dryer drum 12A and a vacuum guide (or transfer) roll 16A disposed between the dryer drum 12A and an adjacent dryer drum 13. As will be seen, the Bel Run system has an advantage over the serpentine run system of FIG. 1 in that the provision of a costly line of lower dryer drums is replaced by smaller vacuum rolls such as 16A. Furthermore, the open draw distance between the dryer drum 12A and the vacuum roll 16A is less than the distance between the dryer drum 12 and the dryer drum 16 of FIG. 1.

However, pocket ventilation roll 16A of the type shown in FIG. 2, are relatively complex and require the provision of a plurality of radial drillings along the entire outer surface 20A thereof. Additionally, such pocket ventilation roll 16A must be hollow and include internal partitions with relatively complex sealing means between such partitions and the inner cylindrical surface of the guide roll 16A. In practice, it has been estimated that, on the average, 65 man-hours are required on the drilling operation alone in order to produce a single vacuum roll. Due to the complexity, vacuum rolls, although smaller than the corresponding lower dryer drums of the serpentine system, are comparable in cost. Thus, the only savings are in the reduction in steam requirements, the reduction in dryer section length and the improvement in runnability.

FIG. 3 is a side-elevational view of the present invention in which the relatively complex vacuum roll such as 16A is replaced by a solid roll 16B having spaced, circumferential grooves defined by the outer surface thereof.

FIG. 4 is an enlarged perspective view of the guide roll 16B. The guide roll apparatus generally designated 22 shown in FIGS. 3 and 4 is disposed adjacent to a dryer 12B of a paper machine drying section generally designated 24. The apparatus 22 guides a contiguous web WB and a web-supporting felt FB through the drying section 24. The apparatus 22 includes the rotatable guide roll 16B having an outer cylindrical surface 20B as shown in FIG. 4. The surface 20B defines a first and second edge portion 26 and 28 respectively and a central portion 30 disposed between the edge portions 26 and 28. The first edge portion 26 defines a plurality of air flow channels 31,32,33,34 and 35 such that in use of the apparatus, when the web WB and the felt FB are guided around the rotatable guide roll 16B, air entrapped between the first edge portion and the felt wrapped around the first edge portion 26 is permitted to flow through the first plurality of channels 31–35 away from the felt FB so that separation of the web WB from the felt FB and the associated fluttering of the web WB during guidance around the first edge portion 26 is inhibited. Similarly, as shown in FIG. 4, the second edge portion 28 defines a second plurality of air flow channels 36,37,38,39 and 40 such that, in use of the apparatus when the web WB and felt FB are guided around the rotatable guide roll 16B, air entrapped between the second edge portion 28 and the felt FB wrapped around the second edge portion 28 is permitted to flow through the second plurality of channels 36–40 away from the felt FB so that fluttering of the web WB and separation of the web during guidance around the second edge portion 28 is inhibited. As shown in FIG. 4, the first and second plurality of air flow channels 31–35 and 36–40 respectively, are a first and a second plurality of spaced, circumferential grooves.

As shown in FIG. 4, the central portion 30 also defines a third plurality of spaced, circumferential grooves 41,42,43,44,45,46 and 47 for inhibiting a buildup of air pressure between the central portion 30 and the felt FB thereby inhibiting detachment of the web WB relative to the felt FB during guidance of the web WB around the guide roll 16B.

As shown particularly in FIG. 5, which is an enlarged fragmentary, cross-sectional view taken on the line 5—5 of FIG. 3, the guide roll apparatus 22 also includes vacuum means generally designated 48 which is disposed adjacent to the guide roll 16B for enhancing the flow of air from the first and second plurality of channels 31–35 and 36–40 respectively. More particularly, FIG. 6, which is a sectional view taken on the line 6—6 of FIG. 5, shows one such vacuum means 48. The vacuum means 48 includes a hood 50 which is disposed within a pocket 52 defined by the guide roll 16B and an ingoing and outgoing side 54 and 56 respectively of the web WB and felt FB. Seal means 58 and 60, disposed between the hood 50 and the outer surface 20B of the guide roll 16B, or the felt, seal the hood 50 relative to the guide roll 16B. The hood 50 is connected to a source of partial vacuum V by ducting 62 as shown in FIG. 5 so that in use of the apparatus 22 the air entrapped between the felt FB and the wrapped portion of the edge portions 26 and 28 respectively, is drawn from the first and second plurality of channels 31–35 and 36–40 and through the hood 50 thereby inhibiting fluttering of the respective edges of the web WB.

Alternatively, the vacuum hood could use air pressure and the Coanda effect to induce a vacuum between the hood and the adjacent roll or felt surfaces.

FIG. 7 is an enlarged, perspective view of an alternative guide roll 16C according to the present invention. As shown in FIG. 7, the first and second plurality of air flow channels are, respectively, a first and second plurality of holes 31C,32C,33C,34C and 35C and 36C,37C,38C,39C and 40C. The holes 31C–35C and 36C–40C are defined by the outer cylindrical surface 20C of the guide roll 16C.

Figure 8:
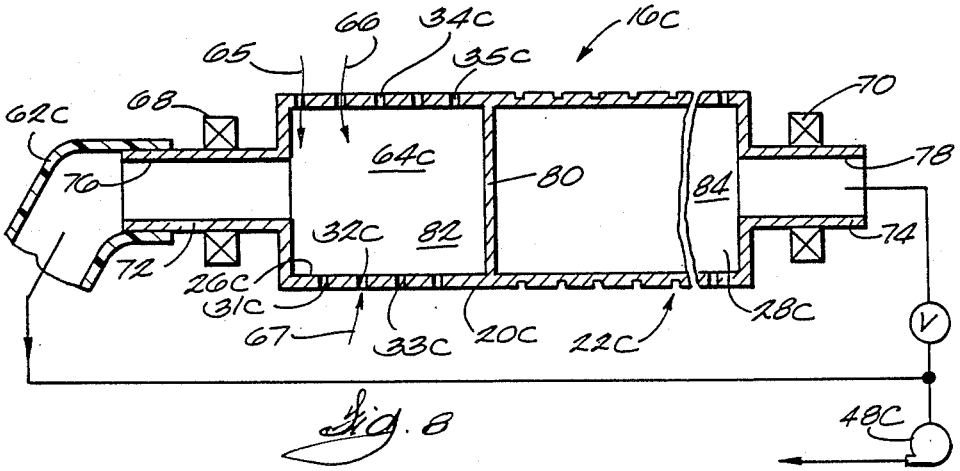
FIG. 8 is a sectional view taken on the line 8—8 of FIG. 7 and shows the journal bearings and the connection of the journals to a source of partial vacuum.

FIG. 8 is a sectional view taken on the line 8—8 of FIG. 7, but also shows the hollow construction of the guide roll 16C and its connection to a vacuum means 48C. As shown in FIG. 8, the holes 31C to 35C are radially drilled relative to the outer surface 20C of the guide roll 16C. As shown in FIGS. 7 and 8, the guide roll 16C also includes an enclosure means generally designated 64C defined by the guide roll 16C. Each hole of the first and second plurality of holes 31C–35C and 36C–40C extends from the enclosure means 64C to the cylindrical surface 20C such that in use of the apparatus 22C air flows through the holes 31C–35C and 36C–40C from the cylindrical surface 20C towards the enclosure 64C as shown by the arrows 65,66 and 67. More specifically, as shown in FIG. 8, the guide roll 16C includes a first and second journal bearing 68 and 70 disposed respectively adjacent to the first and second edge portions 26C and 28C of the guide roll 16C for rotatably supporting the guide roll 16C. A first and second journal 72 and 74 are rigidly connected to, respectively, the first and second edge portions 26C and 28C. The journals 72 and 74 are rotatably supported by the first and second journal bearings 68 and 70 with the first and second journals 72 and 74 defining respectively, first and second bores 76 and 78. The guide roll apparatus 22C includes vacuum means generally designated 48C disposed adjacent to the guide roll 16C for enhancing the flow of air through the first and second plurality of holes 31C–35C and 36C–40C and through the enclosure means 64C which is in fluid communication with respectively the first and second bores 76 and 78. The vacuum means such as a blower fan 48C is connected to, respectively, the first and second bores 76 and 78. A divider plate means 80 as shown in FIG. 8, is disposed within the enclosure means 64C between the first and second edge portions 26C and 28C. The plate 80 divides the enclosure means 64C into a first and second enclosure 82 and 84 respectively so that the first and second enclosures 82 and 84 are in fluid communication with the first and second bores 72 and 74.

Figure 9:
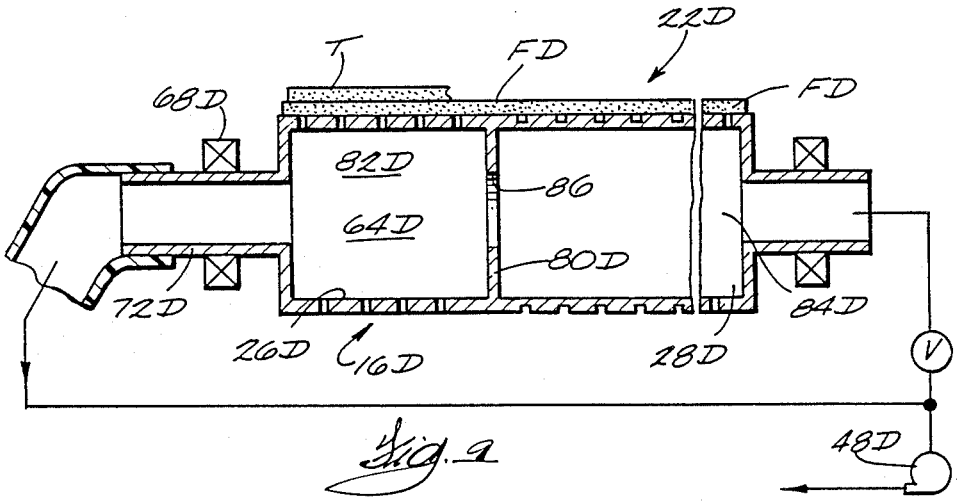
FIG. 9 is a similar view to that shown in FIG. 8 but shows an alternative embodiment of the present invention in which the divider plate defines a restrictor opening such that in use of the apparatus of FIG. 9, when vacuum is applied, a greater vacuum is applied to one edge portion than the other due to the restrictor opening thereby assisting threading of a tail of the web.

FIG. 9 is a similar view to that shown in FIG. 8 but shows a further modification in that the divider plate 80D which is disposed within the enclosure means 64D between the first and second portions 26D and 28D divides the enclosure means 64D into a first and second enclosure 82D and 84D respectively but the divider plate 80D defines a restrictor opening 86. A vacuum means such as a blower fan 48D is disposed adjacent to the guide roll 16D and in fluid communication with the enclosure 82D and enclosure 84D such that in use of the apparatus 22D, when threading a tail T of the web, a greater vacuum is applied to the enclosure 82D which is adjacent to the tail T due to the restrictor opening 86 and closed isolation damper V thereby avoiding the loss of vacuum through the edge portion 28D which is unwrapped by the web WD. The chamber 84D is connected to the vacuum means 48D through bore 78. Additionally, the isolation damper V as shown in FIGS. 8 and 9 has the advantage of providing less pressure drop in the exhaust.

FIG. 10 shows an alternative embodiment of the present invention, however, the vacuum means 48 shown in FIG. 5 is replaced by a blow box 48E having a plurality of slots 88,89 such that when the box 48E is pressurized, air flowing out through the slots 88,89 induces a partial vacuum in the vicinity of the grooves 31E,32E,33E and 34E.

In operation of the apparatus according to FIGS. 3–6, the web supported by the felt is guided around the guide roll 16B with the felt FB being disposed between the outer surface 20B of the guide roll 16B and the web WB. When the apparatus 22 is rotating at high speed, a wedge of air builds up at the ingoing nip NB defined by the felt FB and the outer surface 20B of the guide roll 16B as shown in FIG. 6. This buildup of air pressure tends to cause a pumping action through the permeable felt FB and results in a possible detachment of the web WB from the felt FB. The present invention overcomes this problem by the provision of a plurality of circumferential grooves disposed in a cross-machine direction along the respective edge portions 26 and 28 of the guide roll 16B. The air that would become entrapped if the outer surface were plain, is channeled, according to the present invention, through the annular grooves such that the air can flow around the grooves and out into the pocket 52. Preferably, as shown in FIGS. 5 and 6, a vacuum hood 50 is provided within the pocket 52 to assist in the flow of air from the ingoing nip NB through the grooves and into the hood 50.

In operation of the alternative embodiment of the present invention, as shown in FIGS. 7 and 8, instead of providing a vacuum hood, the guide roll 16C defines a hollow enclosure and a partial vacuum is applied to both hollow journals of the guide roll 16C. Radial holes 31C–35C and 36C–40C are drilled in the vicinity of the edge portions 26C and 28C such that the buildup of air pressure between the felt and the outer surface of the edge portions is dissipated through the holes into the enclosure means 64C towards the vacuum means 48C.

Another embodiment of the present invention includes a divider plate 80D defining a restrictor opening 86. Vacuum means are applied to one journal 72D during threading such that a greater vacuum exists in enclosure 82D than in enclosure 84D. The greater vacuum existing in enclosure 82D is particularly useful in enabling an operator to thread a narrow tail T through the dryer section. Usually, the tail T is approximately 2 inches in width. The width of the edge portions 26D and 28D is large enough to insure the tail is always covered. If no divider plate were employed, then an equal vacuum would be applied through the holes of the edge portions 26D and 28D respectively. Because no web is present adjacent to the edge portion 28D but only a tail T adjacent the edge portion 26D, much of the vacuum applied would be lost through the holes of the edge portion 28D as there would be little resistance to air flow through the unwrapped felt FD adjacent edge portion 28D. Due to the restrictor opening 86 of the present invention, the majority of the vacuum is applied through the edge portion 26D adjacent to the tail T of the web. When the web WD has been threaded, air flow through the holes 36D–40D will be greatly reduced due to the presence of the web. Additionally, the isolation damper, if used, would be opened. Therefore, the effect of the restrictor opening will be minimal with approximately the same vacuum being applied to both edge portions 26D and 28D. Although circumferential grooves of annular configuration have been described, it will be appreciated by those skilled in the art that helical grooves could be used and these are included within the scope of the invention.

The present invention provides an economical guide roll for use in particularly a Bel Run system although such guide roll can be used in many types of web guiding systems. Not only does the present invention provide a guide roll of simple construction requiring minimum machining, but also it provides a simple means for enabling threading of a tail through a drying section.

What is claimed is:

1. A guide roll apparatus disposed adjacent to a dryer of a paper machine drying section, said apparatus guiding a contiguous web and web supporting felt through said drying section, said apparatus comprising:

a rotatable guide roll having an outer cylindrical surface defining a first and second edge portion and a central imperforate portion disposed between said edge portions;

said first edge portion defining a first plurality of air flow channels such that in use of the apparatus, when the web and felt are guided around said rotatable guide roll, air entrapped between said first edge portion and the felt wrapped around said first edge portion is permitted to flow through said first plurality of channels away from the felt so that fluttering of the web during guidance around said first edge portion is inhibited; and said second edge portion defining a second plurality of air flow channels such that in use of the apparatus, when the web and felt are guided around said rotatable guide roll, air entrapped between said second edge portion and the felt wrapped around said second edge portion is permitted to flow through said second plurality of channels away from the felt so that fluttering of the web during guidance around said second edge portion is inhibited.

2. A guide roll apparatus as set forth in claim 1 wherein said first and second plurality of air flow channels are, respectively, a first and second plurality of spaced circumferential grooves.

3. A guide roll apparatus as set forth in claim 1 wherein said first and second plurality of air flow channels are, respectively, a first and second plurality of holes, said holes being defined by said outer cylindrical surface.

4. A guide roll apparatus as set forth in claim 3 wherein said guide roll further includes:

an enclosure means defined by said guide roll, each of said holes extending from said enclosure means to said cylindrical surface such that in use of the apparatus, air flows through said holes from said cylindrical surface towards said enclosure.

5. A guide roll apparatus as set forth in claim 3 wherein said holes are radially-drilled holes.

6. A guide roll apparatus as set forth in claim 1 wherein said central portion defines a third plurality of spaced circumferential grooves for inhibiting a buildup of air pressure between said central portion and the felt thereby inhibiting detachment of the web relative to the felt during guidance of the web around said guide roll.

7. A guide roll apparatus as set forth in claim 1 further including:

vacuum means disposed adjacent to said guide roll for enhancing the flow of air through said first and second plurality of channels.

8. A guide roll apparatus as set forth in claim 7 wherein said vacuum means includes:

a hood disposed within a pocket defined by said guide roll and an ingoing and outgoing side of the web and felt;

seal means disposed between said hood and said guide roll for sealing said hood relative to said guide roll;

said hood being connected to a source of partial vacuum such that in use of the apparatus, said air entrapped between the felt and the wrapped portion of said edge portions is drawn through said first and second plurality of channels and through said hood thereby inhibiting fluttering of the respective edges of the web.

9. A guide roll apparatus as set forth in claim 7 wherein said vacuum means includes:

a hood disposed within a pocket defined by said guide roll and an ingoing and outgoing side of the web and felt;

seal means disposed between said hood and said guide roll for sealing said hood relative to said guide roll;

said hood being a blow box for inducing a partial vacuum such that in use of the apparatus, said air entrapped between the felt and the wrapped portion of said edge portions is drawn through said first and second plurality of channels thereby inhibiting fluttering of the respective edges of the web.

10. A guide roll apparatus as set forth in claim 4 wherein said guide roll further includes:

a first and second journal bearing disposed respectively adjacent to said first and second edge portions of said guide roll for rotatably supporting said guide roll;

a first and second journal rigidly connected to, respectively, said first and second edge portions and rotatably supported by, respectively, said first and second journal bearings, said first and second journals defining, respectively, first and second bores;

said guide roll apparatus further including: vacuum means disposed adjacent to said guide roll for enhancing the flow of air through said first and second plurality of holes and through said enclosure means which is in fluid communication with, respectively, said first and second bores, said vacuum means being connected to, respectively, said first and second bores.

11. A guide roll apparatus as set forth in claim 10 further including:

a divider plate means disposed within said enclosure means between said first and second edge portions for dividing said enclosure means into a first and second enclosure so that said first and second enclosures are in fluid communication, respectively, with said first and second bores.

12. A guide roll apparatus as set forth in claim 4 further including:

a divider plate disposed within said enclosure means between said first and second edge portions for dividing said enclosure means into a first and second enclosure, said divider plate defining a restrictor opening;

a vacuum means disposed adjacent to said guide roll and selectively in fluid communication with one, or both, of said enclosures such that, in use of the apparatus, when threading a tail of the web, a greater vacuum is applied to said enclosure which is adjacent to said tail due to said restrictor opening thereby avoiding the loss of vacuum through that edge portion that is unwrapped by the web.

13. A guide roll apparatus disposed adjacent to a dryer for a paper machine drying section, said apparatus guiding a contiguous web and web supporting felt through said drying section, said apparatus comprising:

a rotatable guide roll having an outer cylindrical surface defining a first and a second edge portion and a central imperforate portion disposed between said edge portions;

said first edge portion defining a first plurality of air flow channels such that in use of the apparatus, when the web and felt are guided around said rotatable guide rolls, air entrapped between said first edge portion and the felt wrapped around said first edge portion is permitted to flow through said first plurality of channels away from the felt so that fluttering of the web during guidance around said first edge portion is inhibited;

said second edge portion defining a second plurality of air flow channels such that in use of the apparatus, when the web and felt are guided around said rotatable guide roll, air entrapped between said second edge portion and the felt wrapped around said second edge portion is permitted to flow through said second plurality of channels away from the felt so that fluttering of the web during guidance around said second edge portion is inhibited; and vacuum means connected to said first and second edge portions of said guide roll for enhancing the flow of air through said first and second plurality of channels.

* * * * *